US008054235B2

(12) United States Patent
Lee et al.

(10) Patent No.: US 8,054,235 B2
(45) Date of Patent: Nov. 8, 2011

(54) ACTIVE MAGNETIC ANTENNA WITH FERRITE CORE

(75) Inventors: Sang-Ha Lee, Suwon-si (KR); Yong-Jin Kim, Seoul (KR); Jae-Ho Lee, Yongin-si (KR); Seung-Hwen Kim, Suwon-si (KR); S. Konstantin Krylov, Moscow (RU)

(73) Assignee: Samsung Electronics Co., Ltd (KR)

( * ) Notice: Subject to any disclaimer, the term of this patent is extended or adjusted under 35 U.S.C. 154(b) by 315 days.

(21) Appl. No.: 12/433,180

(22) Filed: Apr. 30, 2009

(65) Prior Publication Data

US 2009/0289860 A1 Nov. 26, 2009

(30) Foreign Application Priority Data

May 21, 2008 (RU) ..... 2008119950
Mar. 19, 2009 (KR) ..... 10-2009-0023591

(51) Int. Cl.
*H01Q 7/08* (2006.01)

(52) U.S. Cl. ..... 343/788; 343/702; 343/787

(58) Field of Classification Search ..... 343/702, 343/787, 788, 850, 860
See application file for complete search history.

(56) References Cited

U.S. PATENT DOCUMENTS 3,622,890 A 11/1971 Fujimoto et al.
4,403,347 A * 9/1983 Iso et al. ..... 455/193.1
4,805,232 A * 2/1989 Ma ..... 455/291
6,130,645 A * 10/2000 Lindenmeier et al. ..... 343/704
6,529,169 B2 * 3/2003 Justice ..... 343/788
7,688,270 B2 * 3/2010 Tsushima ..... 343/788
2004/0252426 A1 12/2004 Hargrove et al.
2007/0222695 A1 9/2007 Davis
2009/0058755 A1 3/2009 Ozaki et al.

FOREIGN PATENT DOCUMENTS

| | | |
|---|---|---|
| DE | 10 2005 016292 | 10/2006 |
| FR | 2 616 274 | 12/1988 |
| GB | 1 219 543 | 1/1971 |
| JP | 36-25423 | 9/1961 |
| JP | 2004-088508 | 3/2004 |
| JP | 2005-005705 | 1/2005 |
| JP | 2007-295459 | 11/2007 |

OTHER PUBLICATIONS

A. Ye. Kurochkin: "A Broadband Active Magnetic Antenna", Telecommunications and Radio Engineering, vol. 45, No. 4, Apr. 1, 1990, pp. 108-109.

* cited by examiner

*Primary Examiner* — Tho G Phan
(74) *Attorney, Agent, or Firm* — The Farrell Law Firm, P.C.

(57) ABSTRACT

An active magnetic antenna with a ferrite core having a winding is provided, forming a frame magnetic antenna which is connected with a low-noise transistor, to amplify a signal of the frame magnetic antenna. A base of the transistor is connected directly to one contact of the winding, and a second contact of the winding is capable of shifting a voltage of the base of the transistor. The impedance of the frame magnetic antenna is adjusted as a complex conjugate with an impedance of the base of the transistor of the low-noise amplifier, and the winding eliminates its own resonances.

3 Claims, 4 Drawing Sheets

ACTIVE MAGNETIC ANTENNA WITH FERRITE CORE

PRIORITY

This application claims priority under 35 U.S.C. §119(*a*) to Russian Federation Patent Application Serial No. 2008119950 filed May 21, 2008, and to Korean Patent Application Serial No. 10-2009-0023591 filed Mar. 19, 2009, the contents of each of which are incorporated herein by reference.

BACKGROUND OF THE INVENTION

1. Field of the Invention

The present invention relates to radio devices, and in particular, to an antenna with an active magnetic type antenna with a ferrite core for use in compact media digital radio receivers, for receiving Digital Video Broadcasting (DVB) and radio broadcasting signals, including Digital Multimedia Broadcasting (DMB) in VHF and UHF wave lengths.

2. Description of the Related Art

Digital broadcasting standards, such as DVB and DMB, are being developed, with digital broadcasting networks progressively replacing analog TV and radio in the VHF and UHF frequency bands.

An overwhelming majority of small digital multimedia receivers use a telescopic antenna as their basic antenna. This antenna type is well known and widely used for receiving TV signals and for receiving FM signals in handheld receivers.

Although telescopic antennas are somewhat compact in size in a transportation mode, telescopic antennas have a rather long length in an operating mode. For radio receivers operating at VHF frequency band, e.g. VHF III 170-240 MHz band, now used for the Terrestrial Digital Multimedia Broadcast (T-DMB) standard in several countries, the broadcasting wavelength is too long, and an optimum antenna size can reach up to 450 mm, which is unacceptable from the point of view of a user of a small sized handheld device.

A significant shortcoming of telescopic antennas built in to small-sized multimedia receivers is a mechanical unreliability when in a forward position. The various proposed constructional solutions are equally imperfect from the point of view of large length in the radio signal reception mode, and they easily break during use.

Conventional devices that concern construction of ferrite antennas include Russian Federation Patent Application No. 2006122799, disclosing a ferrite antenna containing a pump oscillator, a ferrite core with first and second reception coils fixedly connected, and a first condenser parallel to the reception coils. The Russian Federation Patent Application discloses a coil independent from a ferrite core with a first output connected to a point on the first and second reception coils. The Russian Federation Patent Application further discloses a semi-conductor diode having an anode connected to a second output of the coil, the transistor having a collector connected to a cathode of the semi-conductor diode, and an emitter of the semi-conductor diode connected to a common point, the coil connected to the pump oscillator and magneto-connected with the coil of inductance. The Russian Federation Patent Application further discloses the switching circuit consisting of the resistor, whose first output is connected to the first output of the coil of inductance, and its second output is connected to the base of the transistor, and the second condenser located between base of the transistor and the common point. However, the device disclosed by the Russian Federation Patent Application increases the complexity of adjustment.

A conventional device having an active magnetic antenna with a ferrite core is described in Pub. No. US 2007/0222695 A1, filed by Steven Jay Davis, the contents of which is incorporated herein by reference. This U.S. Publication conceptually represents the main concept of the electric scheme of this active antenna with the ferrite core, as shown in FIG. 1.

In FIG. 1, a ferrite core 1 of the magnetic antenna operates in conjunction with a winding 2 ($L_{ant}$) of the frame magnetic antenna and an LC resonance circuit 3 formed by a second winding of the antenna and a variable capacity condenser for antenna resonance trimming, and a Low Noise Amplifier (LNA). As shown in FIG. 1, an antenna having as a main component a ferrite core 1 is provided with windings forming a frame magnetic antenna, with a first winding 2 connected directly to a base 5 of an LNA transistor, making a first resonant contour in a point of a high-frequency feed of the antenna together with a parasitic capacity of base capacitor Cp.

A resonant LC capacitor of resonance circuit 3, magnetically connected to capacitor Cp, contains a second winding and tuning condenser, providing a two-resonant scheme of the antenna, as used in the majority of compact receivers to allow reception the narrow-band antenna for pre-selection of an operating frequency or frequency adjustment of a radio channel.

The frequency band of this antenna is defined by reconstructing contour 3 and a contour 2 of the high-frequency feed of the antenna in good quality, and reconstructing parameters of the transistor 5 and a coefficient of connection between them in good quality. The antenna described in FIG. 1 has an operating bandwidth of about 10-20 kHz at a half-power level and consequently can be used in analog AM radio receivers for reception of long, middle and short radio waves. For digital channel reception such as DMB or DVB, an antenna's operating frequency bandwidth should be not less than 6-8 MHz. The shortcomings of conventional antennas increase when it is necessary to match all frequency bands. For example, using the T-DMB standard, matching will be 66 MHz from 174 Mhz up to 240 MHz, and 392 MHz bandwidth will used for a DVB-Handheld (DVB-H) standard of 470 Mhz-862 MHz. For so wide operating frequency bandwidth (more than 30%) the antennas which will meet that requirement can be arranged as Ultra-Wide Band (UWB).

Further, a mathematical simulation of the two-resonance circuit solution described above by HFSS™ software demonstrated that there are no improvements in antenna gain compared to a non-resonance ferrite core antenna, with an operating bandwidth determined by antenna gain suppression out of the resonance zone and all attempts to expand the antenna's operating frequency bandwidth are for antenna gain degradation only.

Among the problems solved by present invention is providing a more compact active magnetic antenna having a ferrite core with increased sensitivity, capable of accepting a broadband digital signal without conceding beneficial large telescopic antenna characteristics.

SUMMARY OF THE INVENTION

An aspect of the present invention is to address at least the above-mentioned problems and/or disadvantages and to provide at least the advantages described below. Accordingly, an aspect of the present invention is to provide an active magnetic antenna with a ferrite core, containing a winding, forming a frame magnetic antenna which is connected with a low-noise transistor, capable of amplification of a signal of the frame magnetic antenna, and the base of the transistor is connected directly to one contact of a winding, and the second contact of the winding is capable of submission of a voltage of shifting on the base of the transistor, differing that the impedance of the frame magnetic antenna is adjusted as a complex conjugate with an impedance of the base of the transistor of the low-noise amplifier, and the winding eliminates of its own resonances in a working bank.

In an embodiment of the present invention, a frame magnetic antenna is installed on a circuit board of a radio receiver of the antenna, with a ferrite bar for electromagnetically coupling the user's hands and the radio receiver.

In an embodiment of the present invention, an impedance of the frame magnetic antenna is adjusted as a complex conjugate to the impedance of the base of the transistor of the low noise amplifier due to changing of the number of coils of the frame magnetic antenna and/or a circuit of a collector of the transistor of the low-noise amplifier.

In an embodiment of the present invention, an active magnetic antenna with the ferrite core is provided having a compact size with increased sensitivity, capable of accepting a broadband digital signal by eliminating resonances in an entire operating band by elimination of an LC resonant, and due to the complex interface of an impedance of the frame magnetic antenna (the ferrite core with a winding) with an entry impedance of the transistor which is a part of the antenna, and the winding is connected to the transistor directly, and also due to location of the antenna, to electromagnetically couple the radio receiver with a user's hand, as an additional passive antenna.

The ferrite core antenna of the present invention provides a compact portable multimedia device for reception of digital videos or digital multimedia broadcasting signals in VHF and UHF.

BRIEF DESCRIPTION OF THE DRAWINGS

The above and other aspects, features and advantages of preferred embodiments of the present invention will be more apparent from the following description taken in conjunction with the accompanying drawings, in which.

DETAILED DESCRIPTION OF THE PREFERRED EMBODIMENTS

The following description, with reference to the accompanying drawings, is provided to assist in a comprehensive understanding of preferred embodiments of the invention as defined by the claims and their equivalents. Those of ordinary skill in the art will recognize that various modifications of the embodiments described herein can be made without departing from the scope and spirit of the invention. Descriptions of well-known functions and constructions are omitted for the sake of clarity and conciseness.

Figure 2:
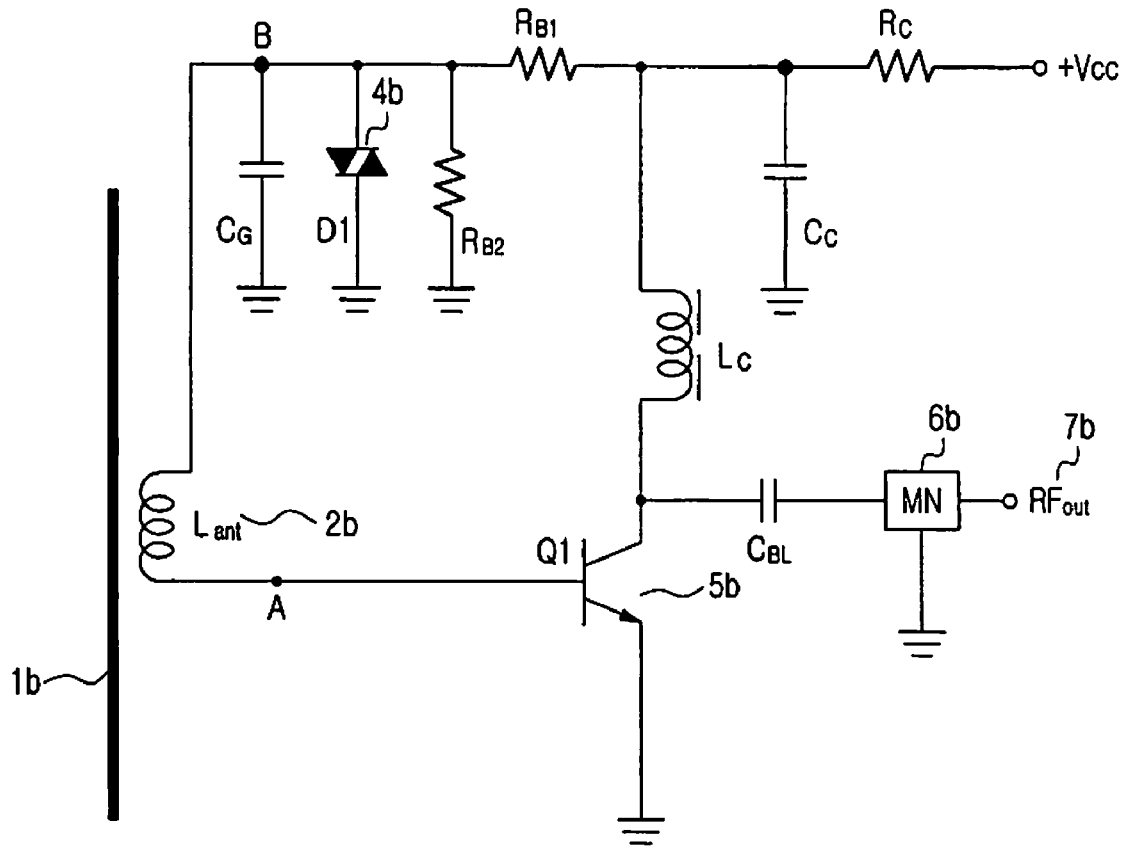
FIG. 2 is a circuit diagram of an active magnetic antenna with a ferrite core of the present invention.

As shown in FIG. 2, a ferrite core of the magnetic antenna 1*b* is provided with a winding of the frame magnetic antenna 2*b* ($L_{ant}$), a protection diode D1 intended for Electro-Static Discharge (ESD) 4*b*, a low noise transistor 5*b* (Q1), which is basic active component of the LNA, a matching circuit at the output of active antenna 6*b*, and a Radio Frequency (RF) output of active antenna 7*b*.

Figure 3:
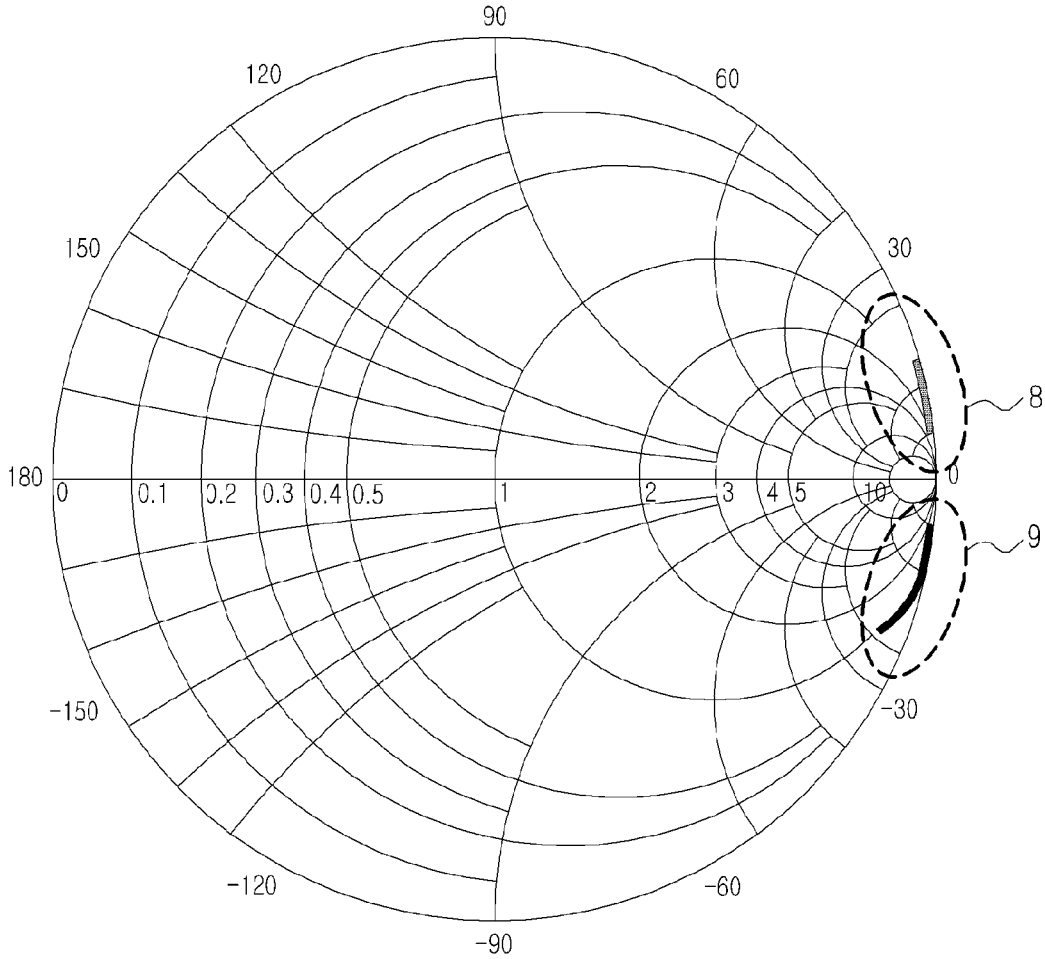
FIG. 3 is a Smith chart showing results of operation of the present invention.

FIG. 3 provides a Smith chart showing a basic principle of matching the input of the frame magnetic antenna between the ferrite core of the antenna and the base of the transistor at a first winding contact (A) shown on FIG. 2. Area 8 of FIG. 3 is an output impedance region of the frame magnetic antenna, and area 9 is an input impedance of the LNA at the transistor base.

Figure 4:
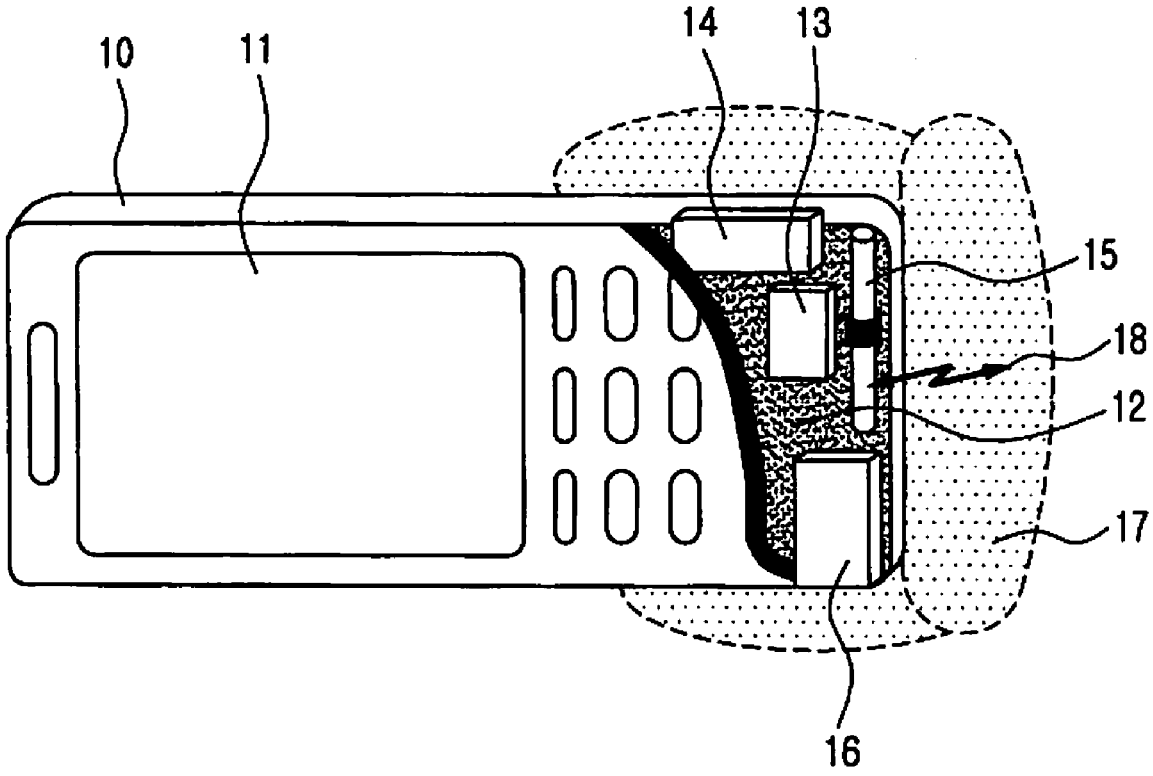
FIG. 4 is a cutaway view of a mobile terminal showing placement of the antenna of the present invention therein.

FIG. 4 provides a cutaway view showing placement of the active magnetic antenna with the ferrite core within a portable multimedia device with a built-in digital radio receiver, for reception of digital video or multimedia broadcasting signals. As shown in FIG. 4, a housing 10 of the portable multimedia device includes a Liquid Crystal Display (LCD) 11 and an area in which the digital components of the portable multimedia device is placed. A main Printed Circuit Board (PCB) 12 of the portable multimedia device includes the active magnetic antenna 13 mounted on PCB 12, a digital receiver 14 mounted on PCB 12, a frame magnetic antenna 15, and another RF receiver 16 useable in the device.

A user's hand 17 in a position holding the portable multimedia device is shown in FIG. 4, with the digital receiver 14 coupled thereto for improved reception of the digital video or multimedia broadcasting signals. Item 18 of FIG. 4 shows an electromagnetic coupling between the ferrite core magnetic antenna of the built-in digital broadcasting receiver 14 and the user's hand 17 holding the portable multimedia device.

The active magnetic antenna contains transistor 5*b* (FIG. 2), connected to the frame magnetic antenna, having as a main element the ferrite core 1. Ferrite core 1 is similar to the core used in a standard pocket AM radio receiver, but the material of core 1 of the antenna of the present invention differs by relatively small magnetic and dielectric losses in VHF and UHF frequency bands. The antenna includes several turns of a copper wire wound around the ferrite core 1*b*, with the number of turns and coil pitch depending upon a selected frequency band and parameters of the ferrite core material. For example, for a T-DMB antenna operating at frequencies of 174 Mhz-240 MHz (VHF III broadcasting band) a ferrite core having a diameter Ø4 mm and length 30 mm is preferably used; with effective dielectric permittivity $\in_r$=16 and effective magnetic permeability $\mu_r$=9, with 4 turns and a 1 mm coil pitch.

One terminal of winding 2*b* of the frame magnetic antenna is connected directly to the base of transistor 5*b*, at the first winding contact (A) (FIG. 2). This transistor simultaneously forms a low-noise and a trans-impedance amplifier. The second terminal of winding 2*b* of the antenna connects to a feed source of the base of the transistor at a second winding contact (B). Control of the transistor is thereby realized through winding 2*b* and the frame magnetic antenna is connected directly to the transistor base at the first winding contact (A) without a matching circuit and the accompanying losses. Winding 2*b* of the frame magnetic antenna is shunted at second winding contact (B) to ground by capacitor $C_G$ by high RF, with a sufficiently high capacity to shunt a radio signal at a low frequency of the operating band. The second winding contact (B) is also shunted to ground by an Electro Static Discharge (ESD) diode 4*b* (FIG. 2), which reliably protects the transistor from high electro-static voltage of an electromagnetic signal, induced on the antenna terminals. However, the ESD diode 4*b* does not influence the antenna or transistor impedances at the first winding contact (A) at radio frequency operation.

Also in FIG. 2, a collector of the transistor has a DC feed through inductor $L_C$, and an amplified RF signal is provided through blocking capacitor $C_{BL}$ and then, if necessary, matched to a 50 Ohm RF output capacitor 7*b*, using matching circuit 6*b*. A current rating of the transistor 5*b* and its bias voltage are adjustable by selection of corresponding resistors $R_{B1}$, $R_{B2}$ and $R_C$ using transistor matching methods known to those of skill in the art. Important characteristics of the amplifier circuit are jointly dependent collector current magnitude and input impedance.

Unfortunately, correct execution of impedance measurement at the first winding contact (A) can be cumbersome, as well as correct mathematical simulation. The cumbersome measurement and simulation is related to connecting the test port to a high-impedance of the first winding contact (A), because characteristics of the amplifier change when the test port is connected to the high-impedance of the first winding contact (A). The test ports for a measuring device have an input impedance of 50 Ohms, sometimes 75 or 100 Ohms.

Figure 1:
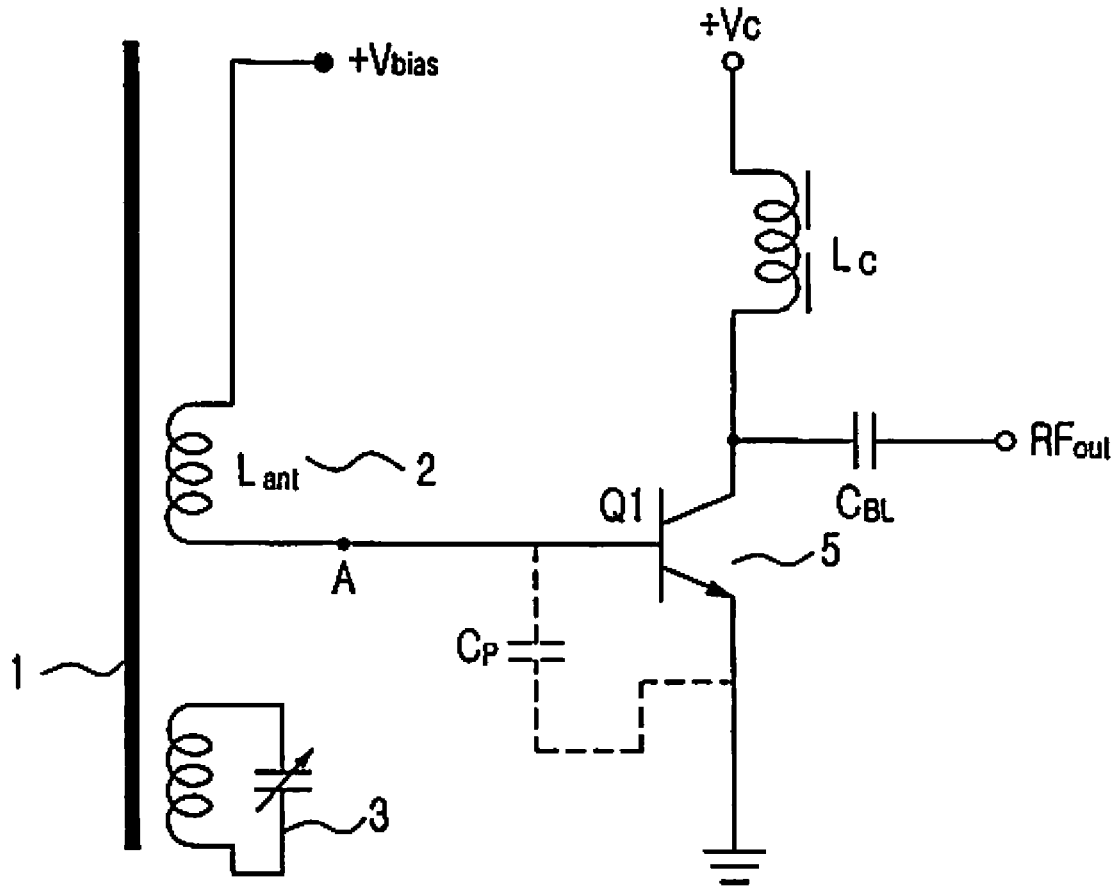
FIG.1 (PRIOR ART)
FIG. 1 is a circuit diagram of a conventional antenna.

Simulations of the circuits of FIGS. 1 and 2 also have problems with correctness because S-parameters of the transistor used as a model of the device are usually measured by a circuit analyzer having 50 Ohm measuring ports. However, winding 2*b* of the ferrite core 1*b* is a passive component and the procedure of measurement of the S-parameters does not present problems with test port influence.

The Smith chart of FIG. 3 provides an overview of a basic concept and principle of matching.

The output impedance 8 of the antenna (FIG. 3) with a ferrite core is adjusted by changing of a number of coils of winding 2*b*, by a pitch of the coil of winding 2*b* and by change of position on the ferrite core 1*b*, relative to center.

Input impedance 9 (FIG. 3) of the transistor 5*b* at the first winding contact (A) is adjusted by collector current tuning. Usually, the transistor has such an input impedance when the collector current value is small in comparison with its optimum 50 Ohm input port operating mode. Accordingly, the gain of such an amplifier will be comparatively less when compared to a nominal value on the same frequency.

Impedances 8 and 9 are necessarily jointly tuned to achieve complex-conjugate impedances. Thus, it is possible to optimize matching between an antenna and LNA at point A, providing a significantly important characteristic having direct influence on the digital receiver sensitivity while at the same time the gain factor of the amplifier does not make any perceptible effect on the receiver.

The prototyping of the active ferrite antenna and its measurement have shown that antenna tuning is necessary to be made in the anechoic chamber, when the antenna under test is connected to the digital receiver which is operating and receiving the test broadcasting signal transmitted by a special test generator through the measuring antenna. By decreasing the power level of the radiated radio signal it is possible to define a threshold of sensitivity for the given digital receiver with the given active antenna, at which the receiving of the signal stops.

In conclusion, it is necessary to note that for the claimed active antenna connected to the digital receiver, there is an opportunity to receive maximum sensitivity only due to adjustment of winding 2*b* of the frame magnetic antenna and adjustments of a current of a collector of the transistor 5. FIG. 4 shows a preferred construction of a compact digital receiver using the active frame magnetic antenna 15 built into housing 10. An optimal arrangement installs antenna 15 on PCB 12 along with other components 13 and 14 of the receiver. In a preferred embodiment, antenna 15 is placed as far as possible from other digital components of the receiver and is spaced apart from LCD 11, to avoid a noise source provided by LCD 11. As shown in FIG. 4, an electromagnetic coupling 18 between a hand 17 of the user and the antenna 15 effectively increases an antenna's aperture, and results in an increased antenna efficiency and improved digital receiver sensitivity. Accordingly, in a preferred embodiment, antenna 15 is positioned in housing 10 as close as possible to the user's hand 17.

To additionally decrease parasitic digital noise, a preferred embodiment places all elements of the analog scheme of FIG. 2 compactly on PCB 12, e.g. in position 13 of FIG. 4, close to the antenna 15. The analog input of digital receiver 14, e.g. an output of an RF microcircuit, is preferably installed at the position 13 and directly connects to output 7*b* of the active antenna (FIG. 2) or through a band pass filter.

From the point of noise suppression, it will be most optimal to install analog parts of digital receivers 16 for other standards at the same area on PCB 12 PCB with antenna 15 and LNA 13. For example, it can be an RF part of the receiver, a duplexer or antenna for CDMA, GSM, Bluetooth® and other standards. In FIG. 4, the variant of the best configuration of a radio receiver of the claimed active magnetic antenna with the ferrite core in the chassis of a radio receiver is shown, at which it is possible to achieve minimization of parasitic digital noise that allows increasing sensitivity of a radio receiver considerably.

In a preferred embodiment, the antenna is formed in a cylindrical or parallelepiped ferrite core arrangement having an optimal length of approximately 20~30 mm, with a cross-sectional area of about 9~20 $mm^2$. The ferrite core preferably possesses electrical characteristics including an effective dielectric permittivity $\in_r$, of about 20; a real magnetic permeability $\mu_r' \leqq 10$; and a dielectric $tg(\delta_\in)$ and magnetic $tg(\delta_\mu)$ tangents of loss angle of the ferrite material of the antenna of $\leqq 0.1$ in the required operating frequency band.

In an embodiment of the present invention, it is important to remove resonances of the antenna in the entire operating frequency band. According to the present invention, resonant circuit 3 in FIG. 1 is preferably completely removed. The impedance of the antenna is a complex conjugate with input impedance of the low-noise transistor of FIG. 1 and the antenna is preferably directly connected to the transistor, to allow a high-resistance impedance of about several hundred Ohms at the antenna output, and application of the matching circuit 6 (FIG. 2) in the transistor output to provide an impedance close to 50 Ohm at output capacitor 7.

In a preferred embodiment the frame magnetic antenna has a ferrite core and a single winding, preferably between one and 5-7 turns, the number depending on parameters of the transistor and material of the ferrite core.

The windings are fabricated by standard industrial methods which are usually used for manufacturing inductance coil. The wire of the winding might be coil-processed or a build-up of the copper layer. Integrally, the frame magnetic antenna with the ferrite core should be fabricated as a radio component for mounting on and will permit assembling on the printed circuit board by a typical chip SMD method. Other components of the active antenna and receiver, such as the transistor and passive components, are assembled on the PCB to be close to the antenna by the same method.

The most optimal area for installation of the claimed active magnetic antenna with the ferrite core on the PCB is a point of the board intended for holding by the user of the multimedia device, to increase the density of power flux of the electromagnetic field through the antenna as a result of electromagnetic coupling with the hand. Thus, the effect of indirect enlargement of the electrical length of the antenna is created, because of the human body having some conductivity. It allows the use of a human body as an additional passive antenna, especially effective in ranges VHF and UHF wavelength, almost equal to the 100 Mhz~1000 MHz frequency range.

When the antenna installed as described above is compared with installation in other places, it has been shown that about 10 dB of sensitivity of reception of the digital signal has been improved in tests of the open area and in the special anechoic chamber.

The basic improvements of the construction, offered by the present antenna are reached by using the following:

1. Adjustments of broadband matching of the active magnetic antenna with the ferrite core.

2. Miniaturization, high reliability and mechanical strength of construction.

3. Searching and using alternative solutions which indirectly allow enhanced antenna gain.

In analog receivers, it is very important to use a narrow-band-pass filter in the receiver's input for selection or preselection of carrier frequency for improvement of signal-to-noise ratio or sensitivity of the received signal. In the most constructions of analog receivers the magnetic antenna with the ferrite core is operating as a narrow-band tunable filter. These circuit solutions essentially differ from the methods of selection of channels used in digital receivers.

The selection by frequency and filtering of a received channel in a digital radio receiver is carried out by methods of digital signal processing (DSP). The selection and filtering in the digital radio receiver are much more qualitative in comparing them to analog receivers. Thus, in the digital receiver, the analog input scheme is used for linear transferring of broadband signals from an antenna to the input of the integrated circuit (IC) of the receiver.

Carrying out practical modeling and measurements according to a preferred embodiment of the present invention have shown that the stable antenna gain and high signal-to-noise ratio in a wide band of frequencies reach up to 50% and more. Dimensions of the ferrite core of a preferred embodiment of the present invention are about 0.017 of the wavelengths $\lambda$ in air for T-DMB standard, only 30 mm in length and 4 mm in diameter. Such a compact ferrite core 1 and 1*b* (FIGS. 1 and 2) along with winding 2*b* can be installed as single component 15 (FIG. 4) on PCB 12 of any handheld multimedia device 10 in a simple and inexpensive manner, such as by surface mounting. The transistor and other components FIGS. 1 and 2, marked as item 13 in FIG. 4 are mounted on the main PCB 12 by surface mounting, preferably on an area not larger than 10 $mm^2$; the total area of such an LNA design does not exceed 10 $mm^2$, thereby substantially reducing the price of this antenna. After installation of all components on PCB 12, such an embodiment of the multimedia device has high mechanical strength; and the antenna will not protrude from housing 10 and will increase reliability.

The correct placement of such an antenna inside of the device 10 is as far as possible from the digital components and LCD 11, and is close as possible to the user's hand 17. In this case the human body increases the aperture of antenna 15 and it essentially (up to 10 dB) increases signal-to-noise ratio in the antenna output. It is possible if the user's hand 17 is close enough to the antenna 15, so that a strong electromagnetic coupling 18 will be created.

The active magnetic antenna with the ferrite core of the present invention can be used for creating built-in antennas, which is intended for operating with typical digital receivers of DVB-T/H, T-DMB/DAB standards and others, inside of Mobile phones, MP3 players, Compact Digital TV sets, DVD players, Compact multimedia players and Ultra-mobile PC (UMPC).

While the invention has been shown and described with reference to a certain exemplary embodiments thereof, it will be understood by those skilled in the art that various changes in form and details may be made therein without departing from the spirit and scope of the invention as defined by the appended claims and their equivalents.

What is claimed is:

1. An active magnetic antenna comprising:

a ferrite bar containing a ferrite core;

a low-noise transistor; and a winding on the ferrite core forming a frame magnetic antenna, wherein the frame magnetic antenna is connected with the low-noise transistor to amplify a signal received by the frame magnetic antenna, wherein a base of the low-noise transistor connects directly to a first winding contact, and a voltage applied to a second winding contact of the low-noise transistor shifts a voltage applied to a collector of the low-noise transistor, wherein an impedance of the frame magnetic antenna is adjusted by a change of voltage input to the collector the low-noise transistor, wherein the second winding contact is shunted to ground via an electro-static discharge diode, wherein a plurality of components of the active magnetic antenna are installed on a radio receiver circuit board, and wherein the frame magnetic antenna is installed on the radio receiver circuit board, whereby the ferrite bar is electromagnetically coupled with a hand of a user of a radio receiver in which the active magnetic antenna is installed.

2. An active magnetic antenna comprising:

a ferrite bar containing a ferrite core;

a low-noise transistor; and a winding on the ferrite core forming a frame magnetic antenna, wherein the frame magnetic antenna is connected with the low-noise transistor to amplify a signal received by the frame magnetic antenna, wherein a base of the low-noise transistor connects directly to a first winding contact, and a voltage applied to a second winding contact of the low-noise transistor shifts a voltage applied to a collector of the low-noise transistor, wherein an impedance of the frame magnetic antenna is adjusted by a change of voltage input to the collector the low-noise transistor, wherein the second winding contact is shunted to ground via an electro-static discharge diode, wherein a plurality of components of the active magnetic antenna are installed on a radio receiver circuit board, and wherein the radio receiver circuit board connects an external passive antenna, wherein the external passive antenna includes at least one of headphones and wire.

3. An active magnetic antenna comprising:

a ferrite bar containing a ferrite core:

a low-noise transistor; and a winding on the ferrite core forming a frame magnetic antenna.

wherein the frame magnetic antenna is connected with the low-noise transistor to amplify a signal received by the frame magnetic antenna, wherein a base of the low-noise transistor connects directly to a first winding contact, and a voltage applied to a second winding contact of the low-noise transistor shifts a voltage applied to a collector of the low-noise transistor, wherein an impedance of the frame magnetic antenna is adjusted by a change of voltage input to the collector the low-noise transistor, wherein the second winding contact is shunted to ground via an electro-static discharge diode, wherein a plurality of components of the active magnetic antenna are installed on a radio receiver circuit board, and wherein impedance of the frame magnetic antenna is adjusted to a complex conjugate of an impedance of the base of the low noise amplifier transistor as a number of coils of the frame magnetic antenna changes or as a collector of the low noise amplifier transistor changes.

* * * * *